United States Patent [19]

Spaude

[11] 4,294,099

[45] Oct. 13, 1981

[54] ROLLING MILL TRAIN

[75] Inventor: Alfons Spaude, Dusseldorf, Fed. Rep. of Germany

[73] Assignee: Schloemann-Siemag Aktiengesellschaft, Dusseldorf, Fed. Rep. of Germany

[21] Appl. No.: 83,264

[22] Filed: Oct. 10, 1979

[30] Foreign Application Priority Data

Oct. 12, 1978 [DE] Fed. Rep. of Germany ..... 2844433

[51] Int. Cl.[3] ..... B21B 1/12

[52] U.S. Cl. ..... 72/234; 72/366

[58] Field of Search ..... 72/229, 234, 226, 199, 72/225, 366

[56] References Cited

U.S. PATENT DOCUMENTS

| | | | |
|---|---|---|---|
| 3,165,948 | 1/1965 | Kishikawa | 72/225 |
| 3,342,053 | 9/1967 | Stammbach | 72/234 X |

FOREIGN PATENT DOCUMENTS

| | | | |
|---|---|---|---|
| 1960601 | 6/1970 | Fed. Rep. of Germany | 72/234 |
| 46-17575 | 5/1971 | Japan | 72/234 |
| 51-109268 | 9/1976 | Japan | 72/366 |

*Primary Examiner*—Milton S. Mehr

*Attorney, Agent, or Firm*—Holman & Stern

[57] ABSTRACT

A material, such as metal, is passed along a rolling mill train to produce a profiled support or rail. At certain stages the passage of the material is reversed so that the material passes through certain rolling stands more than once. The train comprises the following stands: a reversing pre-rolling stand; an edging stand; and a reversing universal rolling stand. After a return passage through the reversing universal rolling stand, the caliber rolls of the edging stand are reduced and the material passes again twice through the edging stand and the reversing universal rolling stand.

8 Claims, 2 Drawing Figures

ROLLING MILL TRAIN

BACKGROUND OF THE INVENTION

The invention relates to a method of using a rolling mill train suitable for rolling heavy profiled supports and rails. The mill comprises a two-high reversing pre-rolling stand, a reversing universal rolling stand and a universal finishing rolling stand with always one preceding compressing stand.

A rolling mill train for rolling profiled supports, and rails is known from the DE-AS 1 960 601 which discloses a reversing universal rolling stand for rolling rails followed and/or preceded by an edging stand which is displaceable transversely to the rolling line. It is a disadvantage of such an arrangement that for each reversing pass in the reversing universal rolling stand, the next caliber following over the axial body length of the reduction rolls must be inserted into the rolling line in order to roll further the side flanks of the profiled rail. It is necessary in this case that the new reduction caliber is positioned accurately in the rolling line, and that accurate adjustment of the reduction caliber to the rolling line must be completed within the period of time between the exit of the end of the rolled material and the entry after the reversal of the stand group with associated roller trains. As has been found by experience, accurate adjustment to the rolling line of the new reduction caliber within the relatively short time available for the change of caliber often presents difficulties. This means that continuous throughput of material and therefore a continuous rolling process is not achieved owing to time delays.

SUMMARY OF THE INVENTION

It is an object of the invention to provide a method that can overcome disadvantages of known rolling mill trains for rolling profiled supports and rails of relatively low throughput power, especially those disadvantages associated with reduction calibers which are displaceable transversely to the rolling line. For example, it is possible to achieve a reduction in the investment cost necessary to obtain the desired caliber succession when rolling rails on universal rolling stands, in particular for the reduction passes necessary to obtain a sufficient rolling out and reinforcing of head and foot pieces.

Thus, the invention consists in a method of rolling, in which material is passed through:

(a) a reversing pre-rolling stand;

(b) an edging stand;

(c) a reversing universal rolling stand, and back again.

(d) the edging stand and back again, both passages being after adjustment of the reduction caliber rolls of the stand; and (e) the reversing universal rolling stand.

We prefer that the material is also passed through:

(f) a second compression stand, and (g) a finishing rolling stand.

The reversing pre-rolling stand, the edging stand, the reversing universal rolling stand, the second edging stand when used, and the universal finishing stand when used are preferably arranged in this order in a line, and the material passed along the line with the necessary reversals.

The axial body length of the reversing pre-rolling stand is preferably afforded a relatively short dimension.

A particular advantage of one arrangement of the rolling mill stands in the rolling mill train is that a reduction caliber of the edging stand associated with the reversing universal stand is used for pre-rolling the pre-forming pass and also for compressing the side flanks with head and foot pieces, of the profiled rail together with the reversing universal rolling stand, by appropriate adjustment of the reduction caliber. Owing to the distribution of a preliminary pass to the edging stand, constructional advantages can be obtained in this case in that the two-high reversing pre-rolling stand can be constructed with a smaller roll crown length and can therefore be built lighter. Problems associated with continuous rolling operation can thus be avoided. Also, trouble-free and operationally reliable rolling operation, and the production of a finished rail profile maintaining tolerance limits can be ensured. This arrangement is preferably employed for rolling mill trains having relatively low throughput power.

BRIEF DESCRIPTION OF THE DRAWINGS

The invention is further illustrated by the accompanying drawings, in which.

DETAILED DESCRIPTION OF THE INVENTION

Figure 1:
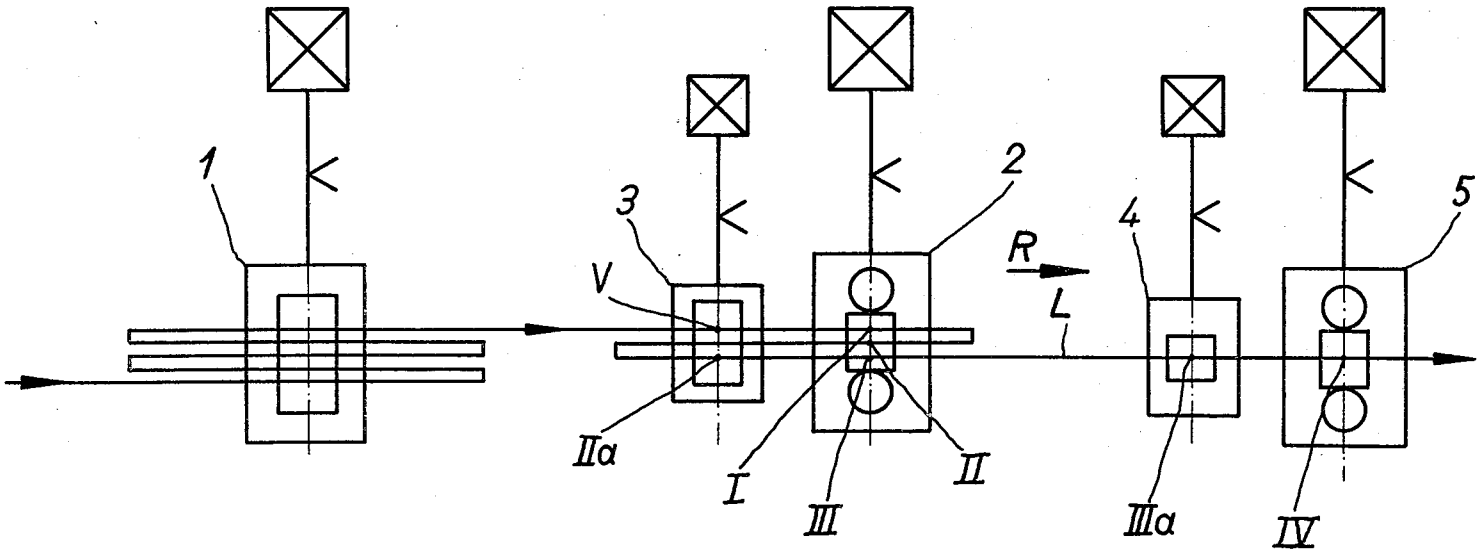
FIG. 1 shows schematically a rolling mill train.

In FIG. 1, a two-high reversing pre-rolling stand 1 carries a rolling material rod W to pre-roll it in reversing operation in a plurality of forward and backward passes in a respective other caliber of the two-high roll set. The last preforming or leader pass V occurs in the caliber of the two-high roll set of the edging stand 3 associated with the universal reversing rolling stand 2 after the rolling material rod W has issued from the two-high reversing pre-rolling stand 1. In this case a rolling pass occurs likewise in the universal reversing rolling stand 2 which is equipped with horizontal and vertical roll sets. After reversal of the universal reversing rolling stand 2, a further return pass is then made in this stand with the two-high rolls of the edging stand 3 open. For the next forward pass in the rolling direction R the two-high rolls of the compression stand 3 are adjusted to the necessary reduction dimension so that a further reduction pass (in stand 3) and a further rolling pass (in stand 2) are effected. Then, the rod W travels from the stand 2 shown as L through the two-high roll set of the edging stand 4 for a further reduction pass, and through the universal finishing rolling stand 5 for a finishing pass in free through-travel. Since the last preforming pass V is displaced from the caliber rolls of the stand 1 to those of the stand 3, the body length of the two-high roll set of the stand 1 may be rendered shorter. This allows the stand to be made lighter, and also the necessary number of reduction passes for satisfactory shaping and reinforcing of the head and foot ends of the rail profile can be ensured with good maintenance of tolerance limits.

Figure 2:
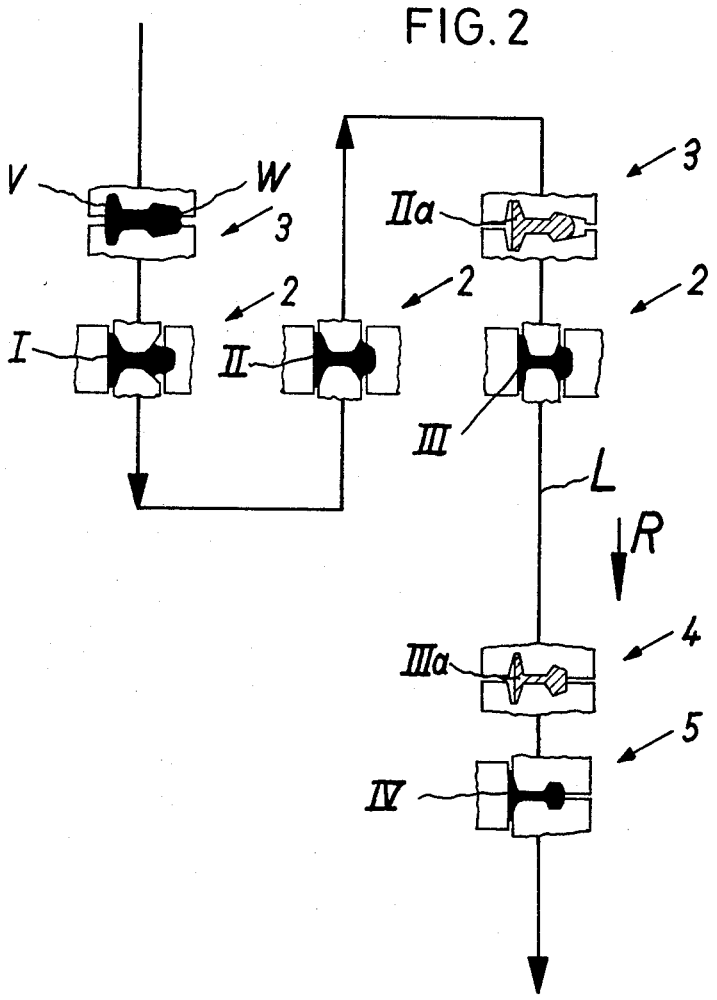
FIG. 2 is a pass plan of a rolling mill train beyond the two-high reversing pre-rolling stand.

FIG. 2 illustrates diagrammatically a pass sequence through the edging stand 3, the universal reversing rolling stand 2 and the edging stand 5. The pre-forming pass in the edging stand 3 is denoted by V, and the first reduction pass in the edging stand 3, with the two-high roll set adjusted, is denoted by IIa. Numerals I, II and III represent the reversing passes in the universal reversing rolling stand, and IIIa represents the second reduction pass in the edging stand 4. The finishing pass in the universal finishing rolling stand 5 is denoted by IV.

I claim:

1. A method of rolling, comprising the sequential steps of:

(a) passing material through a reversing pre-rolling stand;

(b) passing the material through an edging stand a first time;

(c) passing the material through a reversing universal rolling stand;

(d) passing the material back through the reversing universal rolling stand;

(e) passing the material through the edging stand a second time with the reduction caliber roll of the edging stand adjusted from their position in step (b);

(f) passing the material back through the edging stand a third time with the reduction caliber roll of the edging stand adjusted from their position in step (e); and (g) passing the material once again through the reversing universal rolling stand.

2. A method according to claim 1, in which the reversing pre-rolling stand is a two-high reversing pre-rolling stand.

3. A method according to claim 1, in which the material is passed through the reversing pre-rolling stand five times in step (a).

4. The method according to claim 1 further comprising the steps of:

passing the material from the reversing universal rolling stand, after step (g), through a second edging stand; and passing the material from the second edging stand through a finishing rolling stand.

5. A method according to claim 1 or claim 4, in which the reversing pre-rolling stand, the edging stand, the reversing universal rolling stand, the second edging stand when used, and the universal finishing stand when used are arranged in this order, in a line, and the material is passed along the line with the necessary reversals.

6. A method according to claims 1 or 4 wherein the final product is a profiled metal support or rail.

7. Rolling mill train for rolling material to form heavy profiled supports or rails, comprising a two-high reversing pre-rolling stand as well as a reversing universal rolling stand and a universal finishing rolling stand each having a respective preceding edging stand, characterized by: caliber reduction means at the edging stand preceding the reversing universal rolling stand for rolling a final pre-forming pass after the rolled material has issued from the two-high pre-rolling stand; and means responsive to two reversing passes in the reversing universal rolling stand for adjusting said caliber reduction means to the required reduction dimension prior to a third reversing pass and for rolling a reduction pass together with the reversing universal rolling stand.

8. Rolling mill train according to claim 7, characterized in that the two-high reversing pre-rolling stand includes a set of rolls which have an axial body length which is of relatively short dimension.

* * * * *